US007119653B2

(12) United States Patent
Ohtsuka et al.

(10) Patent No.: US 7,119,653 B2
(45) Date of Patent: Oct. 10, 2006

(54) FUSE ELEMENT

(75) Inventors: Haruhito Ohtsuka, Shizuoka (JP); Norio Matsumura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 331 days.

(21) Appl. No.: 10/146,910

(22) Filed: May 17, 2002

(65) Prior Publication Data

US 2002/0196122 A1 Dec. 26, 2002

(30) Foreign Application Priority Data

May 18, 2001 (JP) ..... P2001-149914

(51) Int. Cl.
*H01H 85/08* (2006.01)
*H01H 85/12* (2006.01)
*H01H 85/20* (2006.01)

(52) U.S. Cl. ..... 337/293; 337/295; 337/161

(58) Field of Classification Search ..... 337/159–162, 337/180, 181, 186, 187, 229, 290, 293, 295; 29/623

See application file for complete search history.

(56) References Cited

U.S. PATENT DOCUMENTS

| | | | | | |
|---|---|---|---|---|---|
| 1,227,752 | A | * | 5/1917 | Cole | 337/293 |
| 1,646,629 | A | * | 10/1927 | Ogle | 337/293 |
| 1,856,317 | A | | 5/1932 | Clark | |
| 2,113,169 | A | * | 4/1938 | Carney | 337/253 |
| 2,113,170 | A | * | 4/1938 | Carney | 337/253 |
| 2,794,097 | A | * | 5/1957 | Jacobs, Jr. | 337/278 |
| 3,394,333 | A | * | 7/1968 | Jacobs, Jr. | 337/229 |
| 4,071,837 | A | * | 1/1978 | Ranzanigo | 337/268 |
| 4,498,068 | A | * | 2/1985 | Gaia | 337/293 |
| 4,924,203 | A | * | 5/1990 | Gurevich | 337/231 |
| 5,130,689 | A | * | 7/1992 | Raykhtsaum et al. | 337/296 |
| 5,398,015 | A | * | 3/1995 | Kudo et al. | 337/255 |
| 5,841,338 | A | * | 11/1998 | Yasukuni | 337/293 |
| 6,147,586 | A | * | 11/2000 | Saitoh et al. | 337/297 |

FOREIGN PATENT DOCUMENTS

| | | |
|---|---|---|
| DE | 1 993 602 | 9/1968 |
| JP | 6-290699 | 10/1994 |
| JP | 7-57616 | 3/1995 |
| JP | 7-65690 | 3/1995 |

* cited by examiner

*Primary Examiner*—Anatoly Vortman
(74) *Attorney, Agent, or Firm*—Sughrue Mion, PLLC

(57) ABSTRACT

A fuse element is formed integrally from a conductive metal plate such that two narrow portions are formed side by side between a pair of electrical connection portions. The narrow portions each assume an arch shape and constitute a parallel conductive path. Arch-shaped convex portions are arranged so as to oppose to each other with a predetermined gap therebetween, thus constituting a fusing portion.

10 Claims, 3 Drawing Sheets

FUSE ELEMENT

BACKGROUND OF THE INVENTION

1. Field of the Invention

The present invention relates to a fuse element used in protecting an electric circuit provided in an automobile or the like, and more particularly, to the structure of a fusible portion formed integrally with an electrical connection portion, from a thin metal plate.

The present application is based on Japanese Patent Application No. 2001-149914, which is incorporated herein by reference.

2. Related Art

A related-art automobile fuse of this type will be described by reference to that described in, e.g., Japanese Patent Application Laid-Open No. JP-A-07-65690, and shown in FIG. 5. As shown in FIG. 5, a fuse element P is formed integrally from a conductive metal plate, such as copper. A pair of connection terminals 53 are formed at the respective ends of a narrow portion 51. A thin metal layer is formed from tin on the surface of the fusible portion 51 by plating. A low-fusing-point metal chip 54 is provided in the center and at a position where the greatest amount of heat will develop when an electric current flows through the fusible portion 51. The low-fusing-point metal chip 54 is held by wrapping and caulking crimp pieces formed on the respective side edges of the fusible portion 51, thus forming a fusing portion 52. The fusible portion 51 is bent into an inverted U-shape with the fusing portion 52 taken as a center. The connection terminal portions 53 provided at the respective ends of the fusible portion 51 are connected to an electric circuit.

In order to cause the fusible portion 51 to satisfy a fusing characteristic with as low a resistance value as possible, there is utilized a phenomenon of the low-fusing-point metal chip 54 spreading into the fusible portion 51. A predetermined time lag is ensured by the thin metal layer formed on the surface of the fusible portion 51. However, if a comparatively low overcurrent which does not induce fusing of the fusible portion 51 within the period of the time lag flows through the fuse element repeatedly or if there has frequently arisen a phenomenon of the fusing portion 52 being instantaneously heated as a result of rushed flow of an overcurrent through the fusible portion 51, the low-fusing-point metal chip 54 induces gradual progress in diffusion alloying of the fusing portion 52. As a result, deterioration arises in the characteristic of the fusing portion 52; that is, a characteristic of shortening a time required for fusing the fusing portion 52. Hence, there arises a problem of the fuse element failing to attain predetermined durability.

In order to ensure a fusing characteristic and durability of a fuse, the low-fusing-point metal chip 54 requires complicated manufacturing processes and special management in relation to the purity of material, dimensional accuracy, and maintenance of fixed adhesion of the low-fusing-point metal chip 54 to the fusible portion 51, thereby resulting in low productivity and adding to manufacturing costs.

SUMMARY OF THE INVENTION

The invention has been conceived against the foregoing backdrop and aims at providing a highly durable, reliable fuse element capable of maintaining a fusing characteristic from the domain of a comparatively low overcurrent to a rush current.

The invention also aims at simplifying the construction and assembly processes of a fusible portion, improving productivity of a fuse element, and curtailing manufacturing costs of the fuse element.

To achieve the object, a fuse element comprising a first narrow portion and a second narrow portion made of a conductive metal and having a fusible portion, the first and second narrow portions which constitute a parallel conductive path; and a pair of electrical connection portions connected to said first and second narrow portions; wherein each of the first and second narrow portions is curved in such a manner that convex portions of the first and second narrow portions are arranged so as to oppose to each other with a predetermined gap therebetween.

More specifically, each of the first and second narrow portions is formed substantially in an arch-shape.

In the fuse element having the foregoing construction, heat developing during the course of electrical connection is concentrated at the arch-shaped convex portions of the first and second narrow portions, and an increase in temperature is accelerated by means of thermal interface arising between the mutually-opposing, closest arch-shaped convex portions, thereby achieving a superior fusing characteristic.

Since the fuse element of the invention does not use any low-fusing-point metal chip, diffusion alloying of low-fusing-point metal into the fusible portion does not occur, thereby improving the durability of the use element without involvement of a change in the fusing characteristic.

Further, in the fuse element of the invention, the first and second narrow portions and the electrical connection portions may be formed integrally from a thin metal plate.

The fuse element having the previously-described configuration does not use any low-fusing-point metal chip, and hence manufacture of components is facilitated. Complicated management of a welding process or maintenance of a welded state is obviated, thereby enabling an improvement in productivity.

In the invention, there is also provided a fuse unit comprising: the fuse element as constructed above, a pair of connection terminals attached to the connection portions of the fuse element and a resin housing accommodating the fuse element.

DETAILED DESCRIPTION OF THE PREFERRED EMBODIMENTS

A preferred embodiment of a fuse element according to the invention will be described in detail hereinbelow by reference to the drawings.

Figure 1:
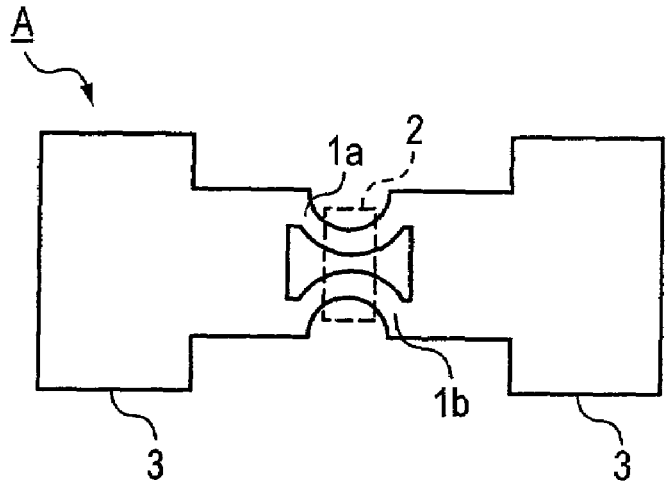
FIG. 1 is a plan view of an embodiment of a fuse element according to the invention.
Figure 2:
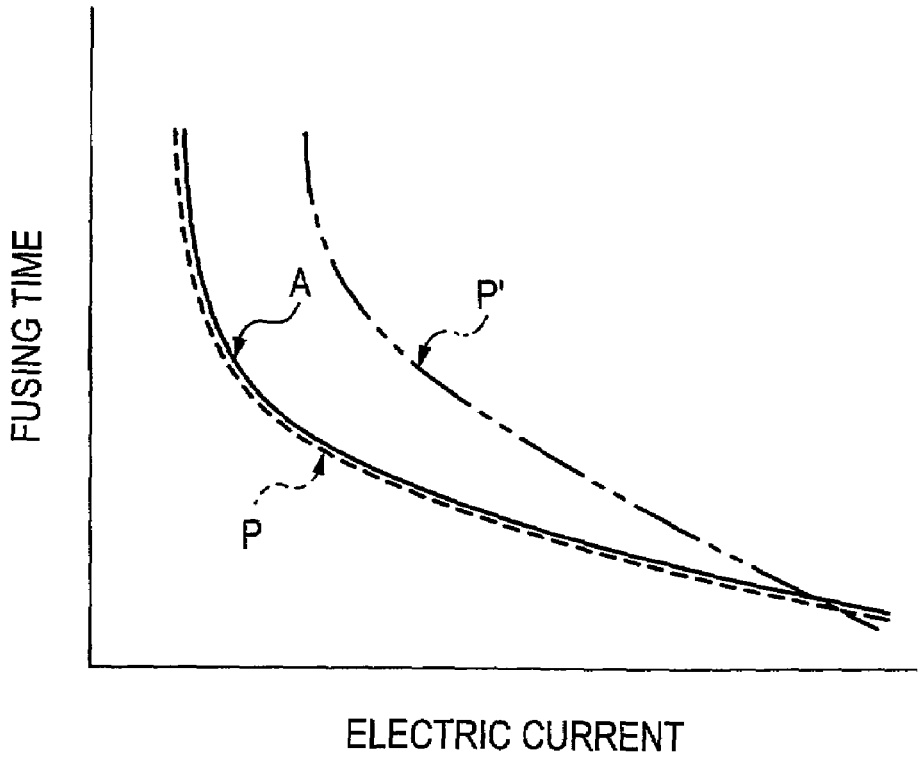
FIG. 2 is a graph showing a fusing characteristic of the fuse element shown in FIG. 1.
Figure 3:
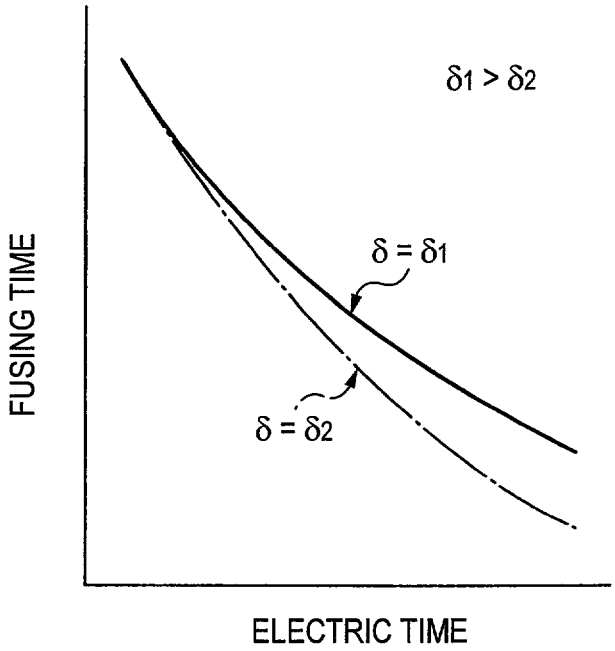
FIG. 3 is a graph showing a fusing characteristic when an interval between narrow portions of the fuse element shown in FIG. 1 is taken as a parameter.
Figure 4:
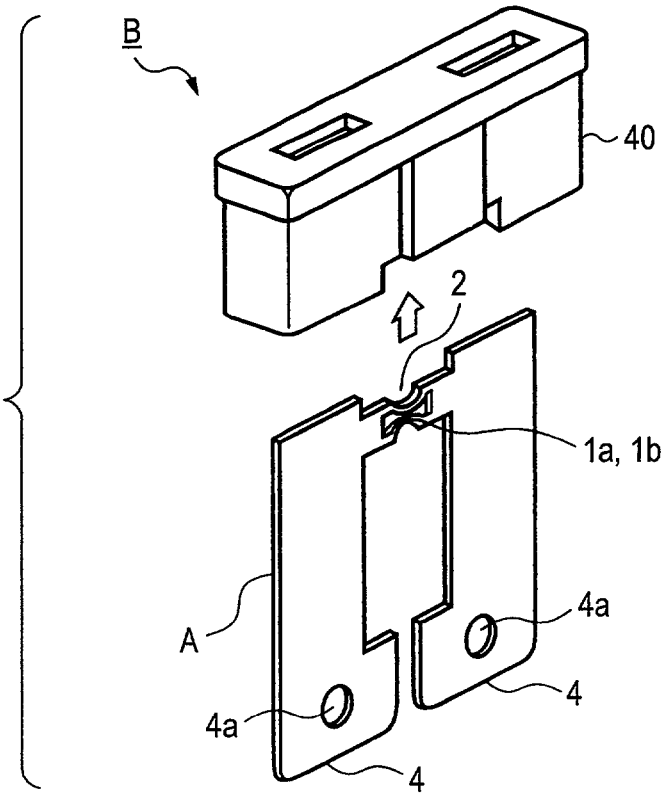
FIG. 4 is an exploded perspective view of a fuse unit to which the fuse element shown in FIG. 1 is applied.
Figure 5:
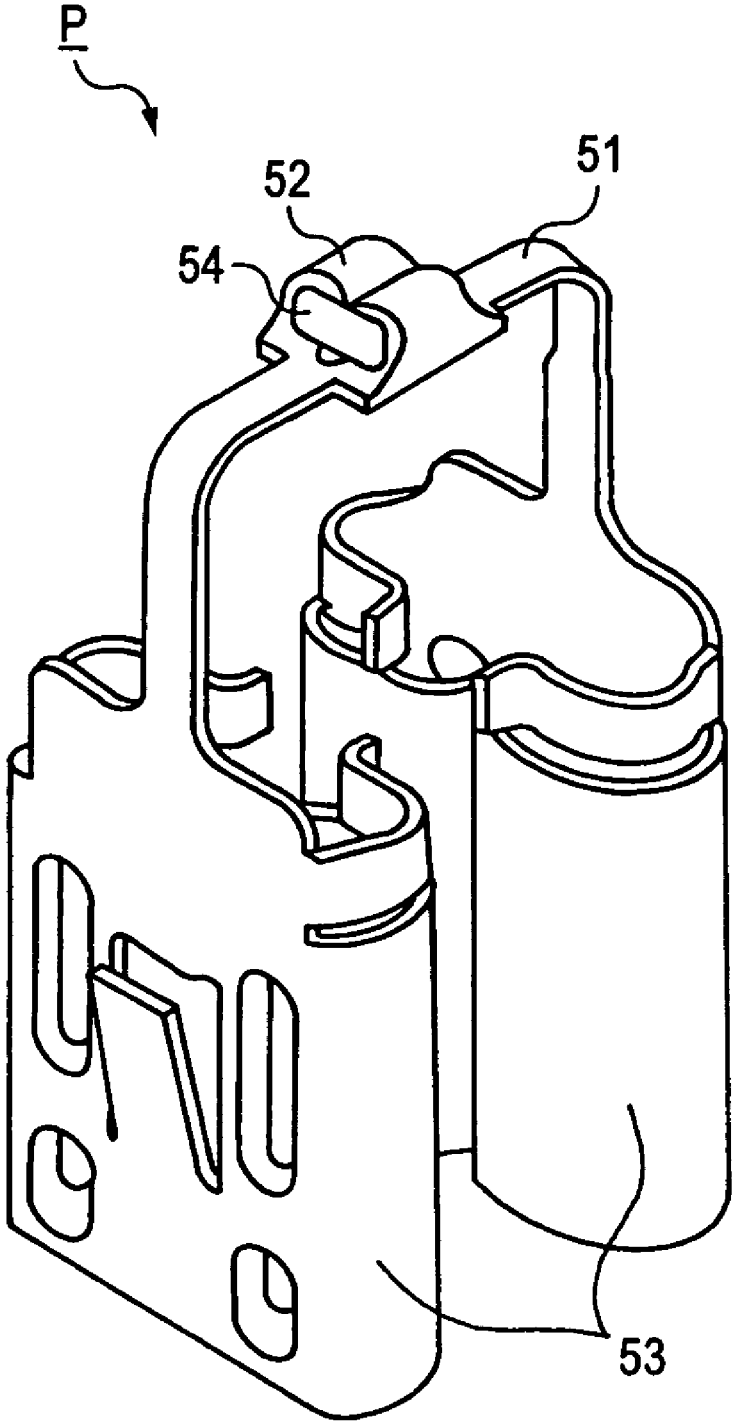
FIG. 5 is a perspective view showing a fuse element of the related art.

FIG. 1 is a plan view showing an embodiment of the fuse element according to the invention. FIG. 2 is a graph showing a fusing characteristic of the fuse element according to the invention. FIG. 3 is a graph showing a fusing characteristic of the fuse element according to the invention when an interval between narrow portions of the element is changed. FIG. 4 is a perspective view of a fuse unit.

A fuse element A shown in FIG. 1 is formed from thin conductive metal plate; e.g., copper, a copper alloy, or aluminum, by pressing. More specifically, the fuse element is formed from a pair of electrical connection portions 3, 3, and two narrow portions 1*a*, 1*b* are provided side by side between the electrical connection portions 3, 3. The electrical connection portions 3, 3 and the narrow portions 1*a*, 1*b* are formed into a single piece.

Each of the narrow portions 1*a*, 1*b* is formed into the shape of an arch. Convex portions of the respective narrow portions 1*a* , 1*b* are arranged so as to oppose to each other, thus constituting a parallel conductive path. The closest portions in the respective centers of the narrow portions 1*a*, 1*b* are spaced a given distance apart from each other, thus constituting a fusing portion 2.

The operation of the fuse element A according to the invention having the foregoing configuration will now be described.

First, there will be considered a case where a comparatively small overcurrent flows through the fuse element A, such as a continuous overcurrent which would flow in the event of occurrence of a rare short-circuit or locking of a motor, or a transient current which would arise at the time of startup of a motor. As a result of flow of such an overcurrent, the narrow portions 1*a*, 1*b* are heated by Joule heat, and undergo an increase in temperature. At this time, the narrow portions 1*a*, 1*b* dissipate heat through the wide electric junctions 3, 3 extending continuously from the respective ends of the narrow portions 1*a*, 1*b*. Hence, a rise in the temperature of the center; that is, a rise in the temperature of the fusing portion 2, becomes comparatively mild. Accordingly, the time that elapses before the fusing portion 2 is fused becomes comparatively longer.

When the overcurrent has disappeared before the fusing portion 2 is fused, the narrow portions 1*a*, 1*b* immediately dissipate heat through the electrical connection portions 3, 3. The temperature of the fusing portion 2 also drops and before long enters a stable state.

When a comparatively small overcurrent has flowed through the fuse element A repeatedly in the manner as mentioned above, the fuse element A according to the embodiment does not employ any low-fusing-point metal which has hitherto been employed in the art. Hence, the narrow portions 1*a*, 1*b* are not susceptible to physical changes such as diffusion alloying. Hence, there arises no deterioration in durability of the fuse element, such as gradual shortening of the time that elapses before fusing of the fuse element.

When a burst overcurrent has flowed through the fuse element A at the time of dead short-circuit of the electric circuit, Joule heat developing in the narrow portions 1*a*, 1*b* also becomes great. Dissipation of the heat through the electrical connection portions 3,3 cannot catch up with generation of the heat. Heat then concentrates on the fusible portion 2, and the temperature of the fusible portion 2 increases sharply. The heat developing in the closest apexes of the arch-shaped convex portions of the narrow portions 1*a*, 1*b* induces mutual thermal inference. An increase in the temperature of the narrow portions 1*a*, 1*b* is accelerated further, and consequently the fusing portion 2 becomes fused within a considerably short period of time.

FIG. 2 shows a fusing characteristic curve representing the relationship between an overcurrent value and the time that elapses before fusion of the fuse element A. The fuse element A according to the invention shows a characteristic substantially identical with that of a related-art fuse element P operating under ideal conditions, over a wide domain of an overcurrent. Particularly, the fuse element A shows a characteristic considerably better in that this fuse element has a wider domain where the fusing time is so short that the connection is cut before damaging the wire or the like, than that of a related-art fuse element P' without mounting low-fusing-point metal chip, wherein the fusing time of the fuse element P' becomes shorter as a result of repeated flow of a continuous overcurrent due to rare short-circuit or locking of a motor, or repeated flow of a rush transient current stemming from startup of a motor.

The fusing characteristic of the fuse element A of the invention changes according to the size of a gap between the closest center portions of the narrow portions 1*a*, 1*b* which constitute the fusing portion 2. If the gap is large, thermal interference arising in the apexes of the arch-shaped convex portions of the narrow portions 1*a*, 1*b* becomes smaller. FIG. 3 shows a fusing characteristic of the fuse element A when a constant cross-sectional area is imparted to each of the narrow portions 1*a*, 1*b* and when an interval δ between the arc-shaped convex portions is taken as a parameter.

As shown in the drawing, a solid line represents the fusing characteristic of the fuse element when $\delta=\delta_1$ , and a dashed line represents the fusing characteristic of the fuse element A when $\delta=\delta_2$ ($\delta_1>\delta_2$). The graph shows that thermal interference becomes greater as the gap δ becomes smaller, thus shortening the fusing time. So long as the cross-sectional area of the fusing portions 1*a*, 1*b* and the gap between the semi-circular-shaped convex portions are selected in accordance with a rating, as required, an optimal fusing characteristic can be achieved in accordance with an application.

A fuse unit B using the fuse element A of the invention will now be described by reference to FIG. 4.

In the drawing, the fuse unit B is formed from a housing 40—which is molded from heat-resistant synthetic resin such as epoxy resin—and the fuse element A. The fuse unit B is constituted by inserting the fuse element A into the housing 40.

As mentioned previously, the fuse element A is formed integrally from a thin metal plate, such as copper, by pressing. A pair of connection terminal portions 4, 4 are formed, such that one connection terminal portion 4 is formed so as to extend from the end of the narrow portions 1*a*, 1*b* having the same construction as that mentioned previously and to assume the shape of the letter C, and the other connection terminal 4 is formed so as to extend from the end of the narrow portion 1*a*, 1*b* in the same manner.

Mount holes 4*a*, 4*a* are formed in the pair of connection terminal portions 4, 4, and the connection terminal portions 4, 4 are mounted, with screws, to equipment such as an electric circuit or a motor.

In this way, the fuse element A is formed as a single component by pressing, whose unit working price is low, thereby obviating assembly of components, which has been performed in the art. Thus, superior productivity is attained, and manufacturing costs can be cut considerably.

The fuse unit B having the foregoing construction is connected in series with an electric circuit and a power supply of equipment, which are objects of protection, or with a part of circuitry. The narrow portions 1*a*, 1*b* of the fuse element A are fused in the fusing portion 2, to thereby disconnect an electric current with an appropriate time lag or immediately when an overcurrent flows through the fuse unit B as a result of rare short-circuit, dead short-circuit having arisen in an electric circuit or equipment, or occurrence of anomalies.

Thus, the fuse unit B can protect an electric circuit or equipment or prevent occurrence of a fire or other accident.

As has been described, a fuse element of the invention can achieve a superior fusing characteristic over a wide range of overcurrent extending from a comparatively-small overcurrent to an anomalous current due to a dead short-circuit without using low-fusing-point metal chip. Further, desired durability and reliability can be ensured.

The fuse element is produced in the form of a single component of a thin metal plate. Hence, the fuse element can be manufactured through inexpensive pressing. There can be realized simplification of assembly processes, improved productivity, and cost reduction.

What is claimed is:

1. A fuse element, comprising:

a first narrow portion and a second narrow portion made of a conductive metal and having a fusible portion, the first and second narrow portions constituting a parallel conductive path; and a pair of electrical connection portions connected to said first and second narrow portions;

wherein the fusible portions of each of the first and second narrow portions are curved in such a manner that convex portions of the fusible portions are arranged so as to approach and oppose each other with a predetermined gap therebetween;

wherein the first and second narrow portions are extended in a single plane and are formed in an arch shape in the plane; and wherein the pair of connection terminals and the first and second narrow portions form a metal plate.

2. The fuse element according to claim 1, wherein the first and second narrow portions and the electrical connection portions are integrally formed from a thin metal plate.

3. The fuse element according to claim 1, the first and second narrow portions are configured so as to be closest at apexes of the first and second narrow portions.

4. A fuse unit comprising:

the fuse element according to claim 1;

a pair of connection terminals attached to the connection portions of the fuse element; and a resin housing accommodating the fuse element.

5. A fuse element, comprising:

a pair of connection terminals generally extending in a first direction;

a connecting portion interconnecting one end of said connection terminals, said connecting portion generally extending in a second direction perpendicular to said first direction; and an insulating housing partially accommodating said connecting portion and said connection terminals, wherein at least a portion of said connecting portion is unclosed;

wherein said connecting portion includes a pair of electrical connection portions and a pair of opposing narrow portions interconnecting the electrical connection portions; and, wherein said opposing narrow portions include fusing portions curved toward each other to define convex portions with a predetermined gap therebetween.

6. The fuse element according to claim 5, wherein the pair of electrical connection portions and the pair of opposing narrow portions form a metal plate.

7. A fuse element, comprising:

a first narrow portion and a second narrow portion made of a conductive metal and having a fusible portion, the first and second narrow portions constituting a parallel conductive path; and a pair of electrical connection portions connected to said first and second narrow portions;

wherein each of the first and second narrow portions is curved in such a manner that convex portions of the first and second narrow portions are arranged so as to approach and oppose each other with a predetermined gap therebetween;

wherein the first and second narrow portions are extended in a single plane and are formed in an arch shape in the plane;

wherein the pair of electrical connection portions and the first and second narrow portions form a metal plate; and wherein the first and second narrow portions have substantially constant cross-sections.

8. The fuse element according to claim 5, wherein the opposing narrow portions have substantially constant cross-sections.

9. The fuse element according to claim 7, wherein the first and second narrow portions have constant cross-sections.

10. The fuse element according to claim 8, wherein the opposing narrow portions have constant cross-sections.

* * * * *